United States Patent [19]

Sasaki et al.

[11] 4,407,000

[45] Sep. 27, 1983

[54] COMBINED DIPOLE AND FERRITE ANTENNA

[75] Inventors: Masanori Sasaki; Isao Yokoyama, both of Tokyo, Japan

[73] Assignee: TDK Electronics Co., Ltd., Tokyo, Japan

[21] Appl. No.: 277,100

[22] Filed: Jun. 25, 1981

[51] Int. Cl.[3] ..... H01Q 7/08; H01Q 21/29

[52] U.S. Cl. ..... 343/726; 343/788

[58] Field of Search ..... 343/701, 725–730, 343/788

[56] References Cited

U.S. PATENT DOCUMENTS 2,581,348 1/1952 Bailey ..... 343/727

*Primary Examiner*—Eli Lieberman

*Attorney, Agent, or Firm*—Ratner & Prestia

[57] ABSTRACT

A small sized reception antenna for VHF and/or UHF band for the use in a room has been found. The antenna has a horizontal dipole type first antenna portion having a folded elongated conductor, and a vertical second antenna portion having a ferrite pole electromagnetically coupled with said horizontal first antenna portion. Said horizontal first antenna portion is rotatable in a horizontal plane, while the second antenna portion is fixed vertically. A tank circuit with a tank coil wound on the ferrite pole and a variable capacitor is provided to resonate the antenna with the reception frequency. An output coil is wound on the ferrite pole, and said output coil provides the output signal of the present antenna. Means for sliding the output coil along the ferrite pole is provided to adjust the output impedance of the present antenna for each of the reception frequencies.

6 Claims, 18 Drawing Figures

COMBINED DIPOLE AND FERRITE ANTENNA

BACKGROUND OF THE INVENTION

The present invention relates to an improved structure of an antenna, in particular, relates to a room antenna having high enough gain and being small enough in size to be suitable for the reception of VHF and/or UHF band. The present antenna is in particular utilized for the reception of an FM broadcasting in 76–90 MHz in Japan.

One of the prior antennas of this kind is shown in FIG. 1A, which is called a ferrite antenna, having a vertical ferrite bar 1. The reference numeral 2 is a tank circuit having a coil 3 wound around the bar 1 and the variable capacitor 4, and 5 is an output coil wound around the ferrite bar 1. A ferrite antenna has been widely used since it provides high output voltage due to the high permiability of a ferrite bar. In FIG. 1A, the variable capacitor 4 provides the resonant condition of the tank circuit 2 by adjusting the capacitor 4, so that the resonant frequency of the tank circuit becomes equal to the desired reception frequency. And, the antenna output is provided from the output coil 5 through the output terminal 6.

The gain G of the ferrite antenna of FIG. 1A is shown below:

$$G = 1.5\mu_e Q_e (3\pi^2/4)\,(S \cdot L_f/\lambda_O)$$

where $\mu_e$ is the effective permiability of the ferrite bar, $Q_e$ is the effective Q of the ferrite bar, S is the cross sectional area of the ferrite bar, $L_f$ is the length of the ferrite bar, and $\lambda_O$ is the free space wavelength. Therefore, the gain G of the antenna is proportional to the values $\mu_e$, $Q_e$, S and $L_f$.

FIG. 1B shows the relationships between the gain G of the ferrite antenna, and the length $L_f$ and the diameter $\phi$ of the ferrite antenna of FIG. 1A, where the values $\mu_e$ and $Q_e$ are given. In FIG. 1B, the vertical axis shows the gain G, the horizontal axis shows the length $L_f$, and $\phi$ is the parameter. As apparent from FIG. 1B, the higher the gain G is, the larger the diameter $\phi$ and the longer the length $L_f$ are.

However, when the size of a ferrite bar exceeds a predetermined threshold value, the gain G of a ferrite antenna is decreased because of the loss by the ferrite core, and further, due to the self inductance and the stray capacitance of the antenna itself, the antenna resonates itself in VHF band. Further, since a ferrite antenna is non-directional in the horizontal plane, when the electromagnetic wave is reflected by buildings and/or other reflectors, the antenna receives an echo due to the multipath by the reflection.

Another prior antenna for VHF and/or UHF band is a half wavelength dipole antenna. However, a conventional dipole antenna has the disadvantage that the size is large as the length of a dipole antenna must be ½ of the wavelength.

SUMMARY OF THE INVENTION

It is an object, therefore, of the present invention to overcome the disadvantages and limitations of a prior antenna by providing a new and improved antenna structure.

It is also an object of the present invention to provide a reception antenna structure for VHF and/or UHF band, having high gain and a small size.

The above and other objects are attained by an antenna comprising a housing; a horizontal first antenna portion having a pair of substantially rectangular wings extending from the top of said housing in the opposite direction from each other; each of said wings having a folded elongated conductor with a plurality of first arms with the length D in the parallel direction of said wings, and a plurality of second arms with the length H in the perpendicular direction to said first arms; extreme ends of said folded elongated conductors in said wings being left free; an elongated ferrite pole positioned vertically in said housing; said ferrite pole having a coupling coil, a tank coil, and an output coil, said coupling coil being coupled with the inner ends of said folded elongated conductors in said pair of wings; said tank coil being coupled with an adjustable capacitor forming a resonator circuit; said output coil being coupled with output terminals; and means for sliding said output coil along said ferrite pole for adjusting output impedance of the present reception antenna.

Preferably, said first antenna portion with a pair of wings has the total horizontal length L in the range from 350 mm to 700 mm.

Preferably, the length D of said first arm being in the range from 6 mm to 12 mm, and the length H of said second arm being in the range from 40 mm to 150 mm.

Preferably, said ferrite pole being a circular post with the diameter in the range from 10 mm to 30 mm, and the length in the range from 50 mm to 150 mm.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 2:
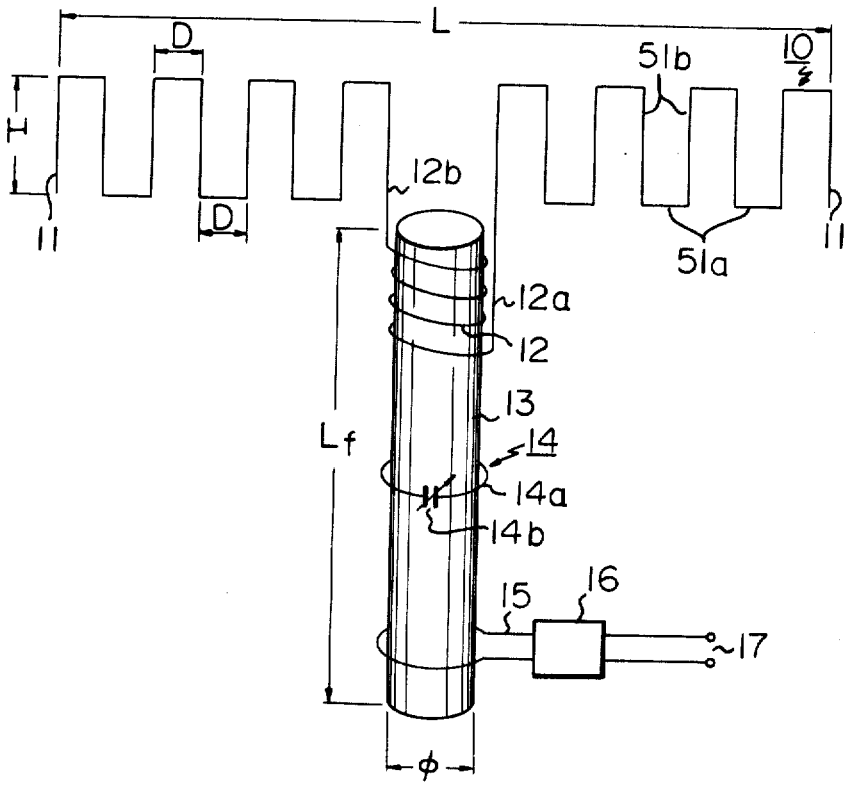
FIG. 2 shows the principle of the present antenna.
Figure 3:
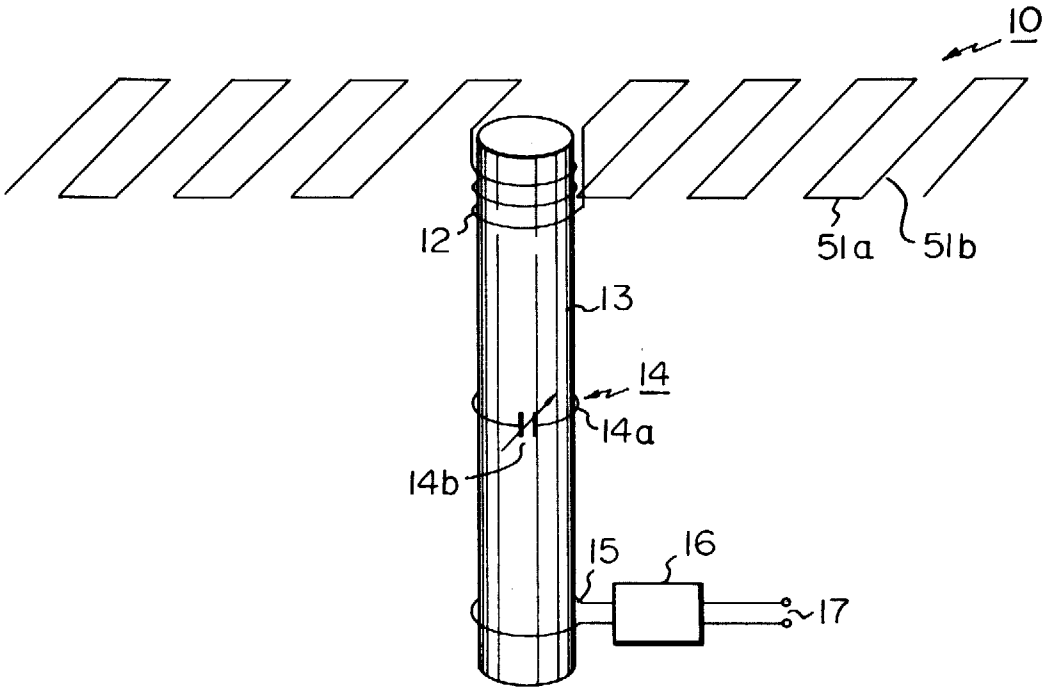
FIG. 3 is another embodiment of the present antenna.
Figure 4A:
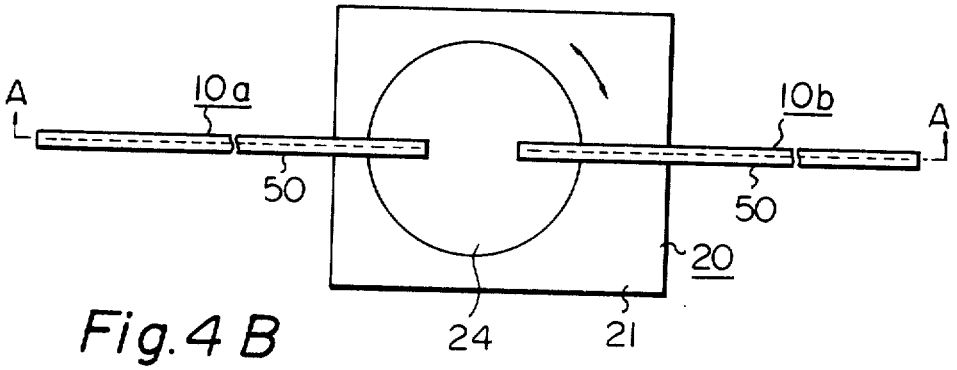
FIG. 4A shows the plan view of the antenna of FIG. 2.
Figure 4B:
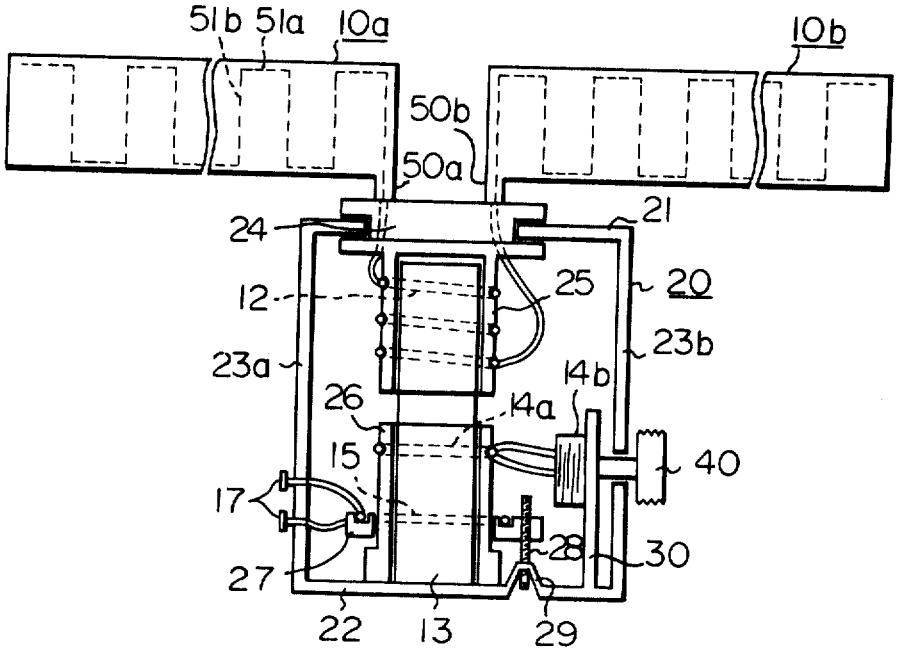
FIG. 4B is the cross sectional view at the line A—A of FIG. 4A, FIG. 5A, FIG. 5B and FIG. 5C show the detailed structure of the lower portion of the antenna of FIGS. 4A and 4B, FIGS. 6A, 6B and 6C show the alternative of the detailed structure of the lower portion of the antenna of FIGS. 4A and 4B.

FIG. 2 and FIG. 3 show the circuit diagrams of the present antenna, and FIGS. 4A and 4B show the structure of the antenna of FIG. 2, wherein FIG. 4A is the plan view, and FIG. 4B is the cross sectional view at the line A—A of FIG. 4A. The present reception antenna has an elongated first antenna portion 10 which extends horizontally, and a ferrite pole 13 which is positioned vertically. A coil 12 is provided at the upper portion of the ferrite pole 13, and the combination of the ferrite pole 13 and the coil 12 wound thereon together with a tank circuit 14 and an output coil 15 compose a second antenna portion. The first antenna portion 10 has an elongated conductor member which is folded or curved repetitively as shown in the figure. In the embodiment of FIG. 2 and FIGS. 4A and 4B, the folded conductor is positioned in the vertical plane. The horizontal component of the folded conductor in the elongated direction of the first portion 10 is called the first arm 51*a*, and the component of the folded conductor perpendicular to said first arm 51*a* is called the second arm 51*b*, respectively. The extreme end 11 of the folded conductor is free or open as shown in the figure. Said horizontal folded conductor is separated to the two portions or wings 10*a* and 10*b* (see FIG. 4A). The ends 12*a* and 12*b* of the coil 12 are connected to the corresponding inner ends of the half portions or wings 10*a* and 10*b*, respectively.

Another coil 14*a* is wound on the middle portion of the ferrite pole 13, and said coil 14*a* is coupled to a variable capacitor 14*b*. The combination of the coil 14*a* and the capacitor 14*b* composes a resonation circuit or a tank circuit. Still another coil 15 is wound at the lower portion of the ferrite pole 13, and said coil 15 is coupled with the output terminals 17 of the present antenna, through the baloon transformer 16 which converts the line impedance. That baloon transformer is not shown in FIGS. 4A and 4B. The coil 15 is called as an output coil.

FIG. 3 shows another circuit diagram of the present reception antenna. The feature of the antenna of FIG. 3 is that the first antenna portion 10 is positioned on a horizontal plane, while that first antenna portion 10 of FIG. 2 is positioned on a vertical plane.

The gain of the antenna of FIG. 3 is almost the same as that of FIG. 2.

Now, the mechanical structure of the antenna according to the present invention will be described in accordance with FIGS. 4A, and 4B. In those figures, the antenna has a housing 20 which has the top cover 21, the bottom cover 22, and the side walls 23*a* and 23*b*. A circular disk 24 is engaged with the top cover 21, so that said disk 24 is rotatable around the axis of the disk 24 itself. The first upper bobbin 25 which is made of dielectric material is fixed beneath said disk 24. The coupling coil 12 is wound around said first upper bobbin 25.

The first antenna portion 10 has the left wing 10*a* and the right wing 10*b*, each comprises of a thin rectangular dielectric plate 50. The plate 50 has a small projection 50*a* or 50*b* at one end of the same, and is fixed on the disk 24 by said projection 50*a* or 50*b*. A folded conductor wire is inserted in the dielectric plate 50 as shown by the dotted line in the figures. The folded wire has the predetermined period, with the horizontal arm 51*a* with the length D and the vertical arm 51*b* with the length H. One end of the conductive wire of each wing is electrically coupled with the related end of the coil 12 through the disk 24, and the other end 11 of the wire is left free. Thus, it should be appreciated that the first antenna portion 10 together with the first upper bobbin and the coil 12 are rotatable around the axis of the bobbin 25. The first antenna portion is positioned in the direction of the electromagnetic wave to be received by rotating the same.

The second lower dielectric bobbin 26 is fixed on the bottom cover 22 of the housing 20, so that said first and second bobbins 25 and 26 are aligned on a common axis. A short air gap is left between the two bobbins 25 and 26. A ferrite pole 13 is inserted in both the first bobbin 25 and the second bobbin 26, and the bottom of the ferrite pole 13 is adhered to the bottom cover 22.

A tank coil 14*a* is wound on the second bobbin 26, and said tank coil 14*a* is coupled with the variable capacitor 14*b* through lead lines. Said variable capacitor 14*b* is fixed to the vertical plate 30 which stands on the bottom cover 22. The variable capacitor 14*b* is adjustable by rotating the knob 40, which is positioned outside of the housing 10. It should be appreciated that the coil 14*a* and the capacitor 14*b* compose a tank circuit or a resonator, which resonates with the reception frequency.

Further, a third bobbin 27 is provided so that said third bobbin 27 is capable of being slid on the second bobbin 26. An output coil 15 is wound on said third bobbin 27, and said output coil 15 is coupled to the output terminals 17 on the side wall of the housing 10. When a balun transformer is mounted in the housing 10, said transformer is inserted electrically between the output terminal 17 and the output coil 15. When said transformer is not mounted in the housing, that transformer is installed outside of the antenna housing. One end of the third bobbin 27 is engaged with the screw 28, which is also engaged with the projection 29 on the bottom plate 22. By rotating the screw 28 with a screw driver, the third bobbin 27 is finely postioned on the second bobbin 26. The positioning of the third bobbin 27 and the output coil 15 define the output impedance of the antenna.

In the above explanation, the bobbins 25 and 26 have a circular slit on the outer wall for accepting the wire of the coils 14*a*, and 15, respectively, and the coils are positioned in those slits.

Figure 5A:
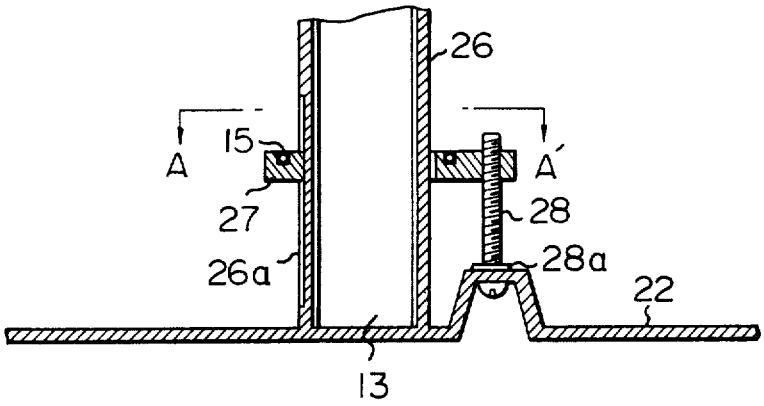
Figure 5B:
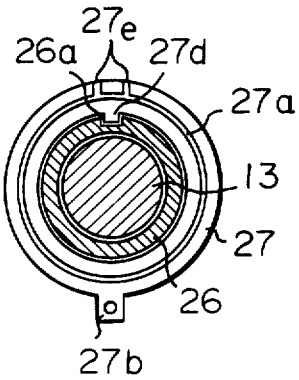
Figure 5C:
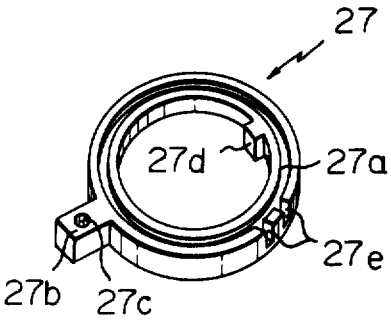

FIGS. 5A, 5B and 5C show the detailed structure of the third bobbon 27 in the embodiment of FIGS. 4A and 4B. In FIGS. 5A through 5C, the second bobbin 26 has a vertical slit 26*a* on the outside wall of the bobbin 26, and the third bobbin 27 has the internal projection 27*d* so that said projection 27*d* is engaged with said vertical linear slit 26*a*. The engagement of the projection 27*d* with the slit 26*a* prevents the undesirable rotation of the third bobbin 27 and/or the output coil 15. The third bobbin 27 has a circular slit in which the output coil 15 is mounted, and the lead lines of said output coil 15 is coupled with the output terminals 17 through a pair of adjacent slits 27*e*. A one turn coil is enough for an output coil for VHF/UHF band. The third bobbin 27 has also an external projection 27*b* which has a female screwed hole 27*c*. The hole 27*c* has a female screw which is engaged with the screw 28, which positiones the third bobbin 27. After the third bobbin 27 is positioned, the screw 28 is locked by a lock nut 28*a*.

Figure 6A:
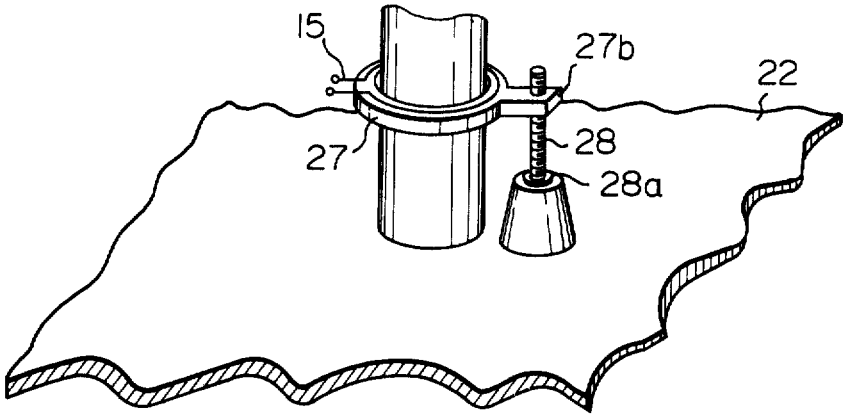
Figure 6B:
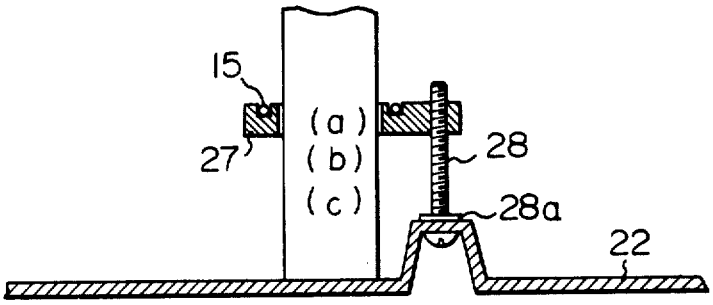
Figure 6C:
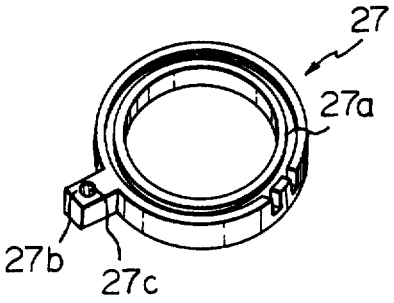

FIGS. 6A, 6B and 6C show the other embodiment of the third bobbin 27. The feature of this embodiment is that no second bobbin is provided and the third bobbin is mounted directly on the ferrite pole 13. In this case, a vertical linear slit may be provided on the ferrite pole 13.

Figure 7:
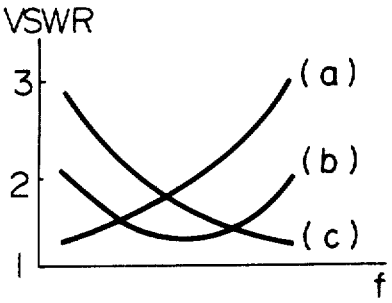
FIG. 7 shows the relationship between the output impedance of the present antenna and the frequency.

FIG. 7 shows the relationship between the reception frequency (horizontal axis) and the output impedance (VSWR; voltage standing wave ratio) of the antenna. The parameters (a), (b) and (c) show the position of the third bobbin 27 (see for instance FIG. 6B). As apparent from FIG. 7, the output impedance of the antenna depends upon the position of the third bobbin or the output coil, and the frequency. Since the matching condition of the output impedance (this condition means that the VSWR = 1) is preferable, the position of the output coil is adjusted for each reception frequency so that the value of VSWR becomes minimum.

In operation, the antenna is positioned so that the ferrite pole 13 is vertical, or the first antenna portion 10 is horizontal. Then, the horizontal first antenna portion 10 is rotated so that the wings 10*a* and 10*b* extend perpendicular to the path of the electromagnetic wave in order to obtain the maximum gain of the antenna. Then, the variable capacitor is adjusted so that the tank circuit resonates with the reception frequency. Then, the positioning of the third bobbin or the output coil is performed so that the output impedance provides the minimum VSWR. The above three operations can be performed so that the reception level becomes maximum. In our experiment, the position of the output coil does not effect much to the gain of the antenna. Therefore, that position of the output coil might be fixed after that output coil is adjusted to a proper location for a middle frequency in the reception frequency band.

Now, the characteristics of the present antenna, and some design consideration are described in accordance with FIGS. 8 through 11.

It is preferable for the practical use of an antenna that the size of a ferrite pole 13 has the diameter $\phi$=6–35 mm, and the length $L_f$=25–200 mm, and the output impedance 300 ohms, which will match with the input impedance of a baloon transformer. When the size of a ferrite pole is small, both the gain and the output impedance are decreased, and when the size of a ferrite pole is large, the output impedance is increased and the gain is then decreased due to the mismatching of the impedance.

Figure 8:
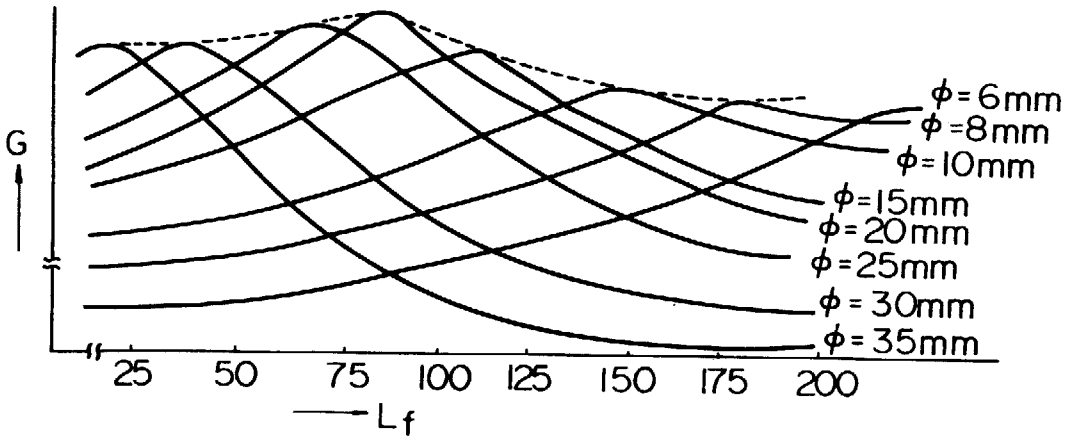
FIG. 8 shows the relationship of the gain and the size of a ferrite rod of the antenna of FIG. 2, FIG. 9A and FIG. 9B show curves of the gain with the parameter of folded horizontal portion.

FIG. 8 shows the relations between the length $L_f$ of a ferrite pole and the gain G of the antenna of FIG. 2, with the parameter of the diameter $\phi$ of the ferrite pole, where the horizontal axis shows the length $L_f$ in mm and the vertical axis shows the gain G, and the test frequency is 83 MHz. As apparent from FIG. 8, it is preferable to obtain the high gain that the diameter $\phi$ is in the range from 8 mm to 30 mm, and the length $L_f$ is in the range from 50 mm to 200 mm. In the above range, the maximum gain is obtained when the diameter is approximately 20 mm, and the length $L_f$ is approximately 75 mm. When the size is in the above range, the measured output impedance of a ferrite antenna is in the range from 100 ohms to 200 ohms, and the output impedance of the horizontal first antenna portion is in the range from 30 ohms to 150 ohms. And, when the size is chosen to provide that maximum gain ($\phi$=20 mm, $L_f$=75 mm), the measured output impedance of the second ferrite antenna portion is 150 ohms, and the measured output impedance of the first horizontal antenna portion is 80 ohms. Those values of the output impedance do not include the effect of the coupling coil 12 of FIG. 2, in other words, the first antenna portion is separated from the second ferrite antenna to measure the output impedance of the two portions separately. In a practical embodiment, the first horizontal portion, and the vertical ferrite pole portion are coupled through that coupling coil 12, and the preferable output impedance of the combined antennas of the first horizontal portion and the vertical ferrite pole portion is 300 ohms.

Figure 9A:
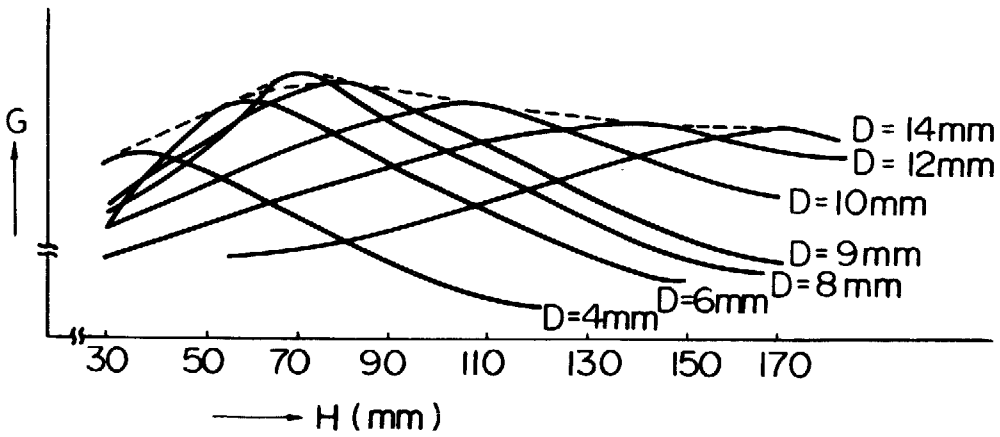

FIG. 9A shows the gain of the antenna of FIG. 2 when the length (D) of the first arm 51*a*, and the lenght (H) of the second arm 51*b* (see FIG. 2) are adjusted where the diameter $\phi$ and the length $L_f$ of the ferrite pole are selected so that the gain of the ferrite pole is maximum ($\phi$=20 mm, $L_f$=75 mm), the vertical axis shows the gain G, the horizontal axis shows the length (H) of the second arm 51*b*, and the parameter is the length (D) of the first arm 51*a*. As apparent from FIG. 9A, the gain G is high when the length (D) is in the range from 6 mm to 12 mm, and the length (H) is in the range from 40 mm to 150 mm. And, the maximum gain is obtained when the length (D) is approximately 8 mm, and the length (H) is approximately 60 mm.

Figure 9B:
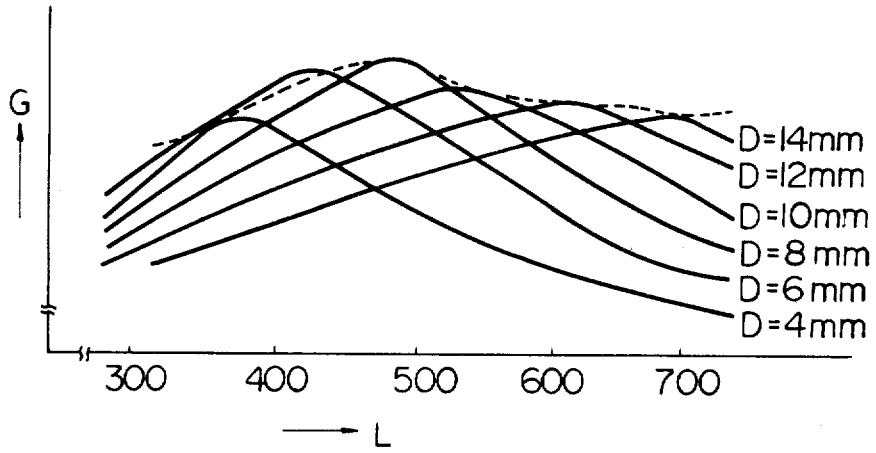

FIG. 9B shows the measured gain of the antenna of FIG. 2 when the horizontal total length L of the first antenna portion 10 (see FIG. 2) is adjusted, where the vertical axis shows the gain G of the antenna of FIG. 2, the horizontal axis shows the length L of the horizontal first antenna portion, and the parameter is the length (D) of the first arm 51*a* of the folded conductor, where the length (H) is fixed to be H=60 mm. As apparent from FIG. 9B, the gain is high when the length (D) of the first arm 51*a* is in the range from 6 mm to 12 mm, and the length L of the horizontal portion is in the range from 350 mm to 700 mm. And, the maximum gain is obtained when the length (D) is approximately 8 mm, and the length L is approximately 480 mm.

Figure 1A:
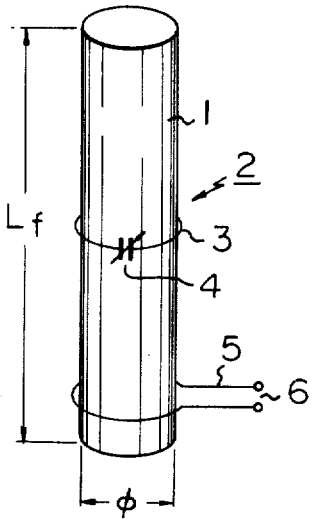
Fig. 1A PRIOR ART
FIG. 1A is a structure of a prior ferrite antenna.
Figure 1B:
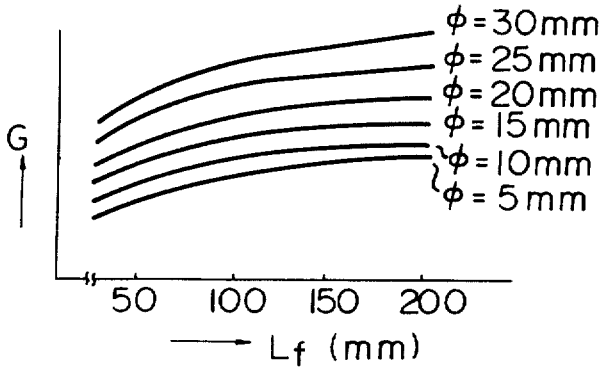
Fig. 1B PRIOR ART
FIG. 1B shows the relations between the gain of the ferrite antenna and the size of the antenna.
Figure 10:
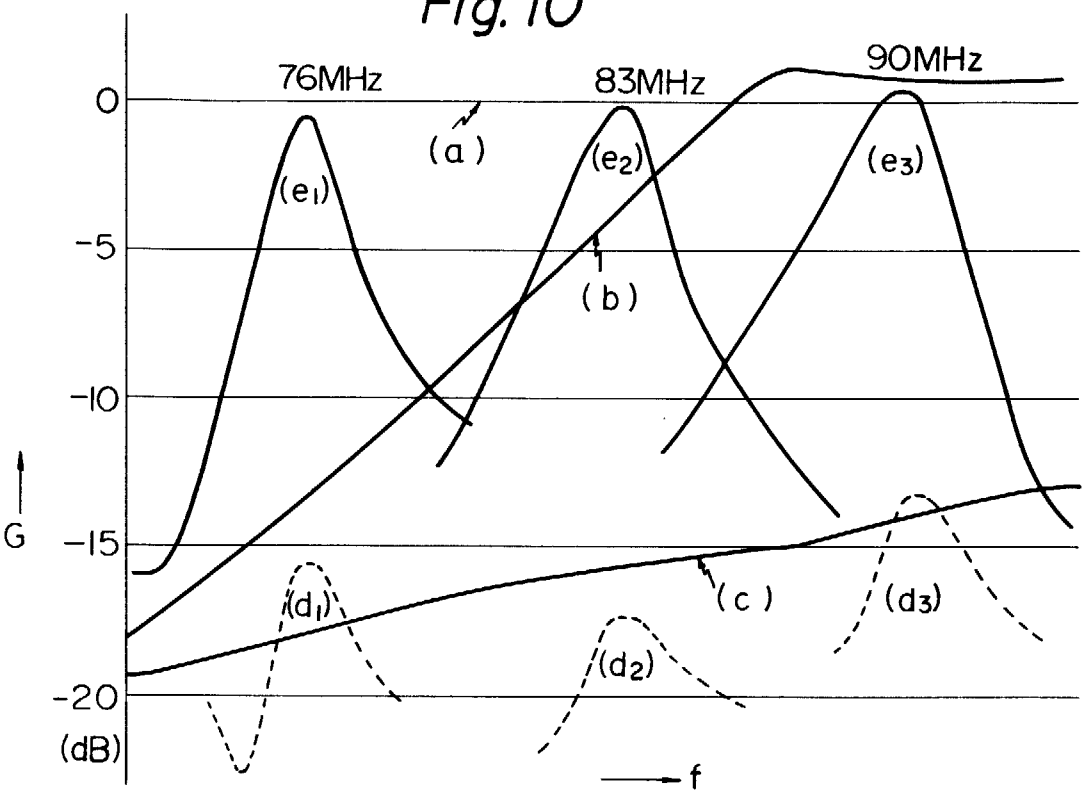
FIG. 10 shows the curves of the gain of the present antenna, as compared with the gain of prior antennas.

FIG. 10 shows the comparison of the gain of the present antenna with some prior antennas, where the vertical axis shows the gain in dB, the horizontal axis shows the frequency in MHz. The antenna which was tested according to the present invention has the size that the diameter $\phi$ of the ferrite pole is 20 mm, the length $L_f$ of the ferrite pole is 75 mm, the length (H) of the second arm 51*b* of the folded conductor is 60 mm, the length (D) of the first arm 51*a* of the folded conductor is 8 mm, and the length L of the first antenna portion 10 is 480 mm. In FIG. 10, the curve (a) shows the characteristics of the prior standard dipole antenna with the length 1800 mm (=½ wavelength for 83 MHz), the curve (b) shows the characteristics of the prior standard dipole antenna with the length 1000 mm, the curve (c) shows the characteristics of the prior standard dipole antenna with the length 600 mm, the curves ($d_1$), ($d_2$) and ($d_3$) show the characteristics of the prior ferrite antenna of FIG. 1A, and the curves ($e_1$), ($e_2$) and ($e_3$) show the characteristics of the present antenna of FIG. 2, where ($d_1$) and ($e_1$) are resonated in 76 MHz, ($d_2$) and ($e_2$) are resonated in 83 MHz, and ($d_3$) and ($e_3$) are resonated in 90 MHz. As apparent from FIG. 10, the present antenna which is only 480 mm in the horizontal length has almost the same gain as that of the prior standard half-wavelength dipole antenna with the length 1800 mm. In the experiment of FIG. 10, the present antenna was turned at the frequencies 76 MHz, 83 MHz, and 90 MHz, by adjusting the variable capacitor 14*b* (see FIG. 2).

Figure 11:
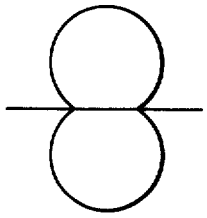
FIG. 11 shows the directivity characteristics of the present antenna.

FIG. 11 shows the directional gain in the horizontal plane of the present antenna. As shown in FIG. 11, the present antenna has the so-called '8-shaped' directivity. Therefore, when there are many transmission stations, the antenna must be directed to the desired transmission station by rotating the first horizontal antenna portion 10, every time we tune the desired station. In this case, it should be appreciated that the tuning and/or rotation of the present antenna is very easy since the horizontal length of the present antenna is very short as compared with a prior standard half-wavelength dipole antenna.

Therefore, the present antenna is suitable as a room antenna for the reception antenna of VHF/UHF band, and the present antenna has almost the same gain as the prior large standard half-wavelength dipole antenna, in spite of the small size of the present antenna.

As explained above in detail, the present antenna is small in size as compared with a prior dipole antenna, in spite of the high gain. Further, the rotation or the adjustment of the direction of the antenna is very easy. Thus, an excellent room antenna for the VHF/UHF bands has been found.

From the foregoing, it will now be apparent that a new and improved structure of an antenna has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A reception antenna structure comprising;

a housing, a horizontal first antenna portion having a pair of substantially rectangular wings extending from the top of said housing in the opposite direction from each other, each of said wings having a folded elongated conductor with a plurality of first arms with the length D in the parallel direction of said wings, and a plurality of second arms with the length H in the perpendicular direction to said first arms, extreme ends of said folded elongated conductors in said wings being left free, an elongated ferrite pole positioned vertically in said housing, said ferrite pole having a coupling coil, a tank coil, and an output coil, said coupling coil being coupled with the inner ends of said folded elongated conductors in said pair of wings, said tank coil being coupled with an adjustable capacitor forming a resonator circuit, said output coil being coupled with output terminals, said first antenna portion with a pair of wings having the total horizontal length L in the range from 350 mm to 700 mm, the length of said first arm being in the range from 6 mm to 12 mm, and the length of said second arm being in the range from 40 mm to 150 mm, and said ferrite pole being a circular post with the diameter in the range from 10 mm to 30 mm, and the length in the range from 50 mm to 150 mm.

2. A reception antenna structure comprising;

a housing having a top cover, a bottom cover, and side walls, a disk positioned rotatably on the top cover of said housing, a horizontal dipole type first antenna portion having a pair of wings located on said top cover of the housing so that those wings extend in the opposite direction from each other, each of said wings having a plastic plate and a folded elongated conductor moulded in said plate, said conductor having a plurality of first arms with the length (D) in the parallel direction of said wings, and a plurality of second arms with the length (H) in the perpendicular direction to said first arms, extreme ends of said folded elongated conductors in said wings, being left free, an elongated ferrite pole positioned vertically in said housing, a first bobbin fixed to said disk and covering the upper portion of said ferrite pole, a second bobbin covering the lower portion of said ferrite pole, a coupling coil wound on said first bobbin and being electrically coupled with the inner ends of said folded elongated conductors in said pair of wings, a tank coil wound on bobbin, bobbin connected to a variable capacitor, terminals, a third bobbin located on said second bobbin so that said third bobbin can slide vertically along said second bobbin, an output coil (15) wound on said third bobbin (27), and being electrically coupled with a pair of output terminals (17), adjusting means for sliding said output coil along said second bobbin, said first antenna portion with a pair of wings having the total length in the longitudinal direction of the same in the range from 350 mm to 700 mm, the length of said first arm being in the range from 6 mm to 12 mm, and the length of said second arm being in the range from 40 mm to 150 mm, and said ferrite pole having a circular cross section with the diameter in the range from 10 mm to 30 mm, and the length in the range from 50 mm to 150 mm.

3. A reception antenna structure according to claim 2, wherein said folded elongated conductor is substantially in the vertical plane.

4. A reception antenna structure according to claim 2, wherein said folded elongated conductor is substantially in the horizontal plane.

5. A reception antenna structure according to claim 2, wherein said sliding means has a female screw on the third bobbin and a screw engaged with said female screw so that the rotation of the screw slides the third bobbin along the second bobbin.

6. A reception antenna structure according to claim 2, wherein said sliding means has a vertical slit, and said third bobbin has an internal projection which is slidably engaged with said slit.

* * * * *